US005153395A

United States Patent [19]

Schantz et al.

[11] Patent Number: 5,153,395

[45] Date of Patent: Oct. 6, 1992

[54] LID SWITCH FOR CLOTHES WASHING MACHINE

[75] Inventors: Spencer C. Schantz, Dousman; Mike Lehn, Hartland; Dave Falcon, Oak Creek; Steve Lovas, Hales Corners, all of Wis.

[73] Assignee: U.S. Controls Corp., New Berlin, Wis.

[21] Appl. No.: 604,781

[22] Filed: Oct. 26, 1990

[51] Int. Cl.[5] ..... H01H 21/04; H01H 9/02

[52] U.S. Cl. ..... 200/61.62; 200/61.81; 200/61.82; 200/306

[58] Field of Search ..... 200/61.62, 61.64, 76, 200/61.82, 61.81, 306; 61/58 R

[56] References Cited

U.S. PATENT DOCUMENTS 4,963,706 10/1990 Mohtasham ..... 200/61.62

4,968,862 11/1990 Maeda ..... 200/306

*Primary Examiner*—Howard L. Williams

*Assistant Examiner*—D. Le

*Attorney, Agent, or Firm*—Fuller, Ryan, Hohenfeldt & Kees

[57] ABSTRACT

A switch operated to an open circuit condition by a closed lid of an automatic clothes washing machine. The switch housing is comprised of two parts which mate with each other and with the specially configured switch operating shaft for inhibiting entry of liquids into the switch contact chamber of the housing by splashing or by capillarity. A vent tube leads from the housing and, in effect, accepts air resulting from the air in the housing expanding when the switch is warm and which allows back flow of that air into the housing when the air in the housing cools. The tube prohibits pressure developing in the housing which is negative with respect to ambient atmospheric pressure.

18 Claims, 3 Drawing Sheets

LID SWITCH FOR CLOTHES WASHING MACHINE

BACKGROUND OF THE INVENTION

Home clothes washing machines must either keep the lid locked in a closed position during the spin dry cycle to prevent access to the rapidly rotating basket in the machine that contains the materials which are being laundered or the motor driving the basket must be braked and stopped as soon as anyone begins to open the lid.

For the latter, it is necessary to provide a switch which changes state immediately upon initiating opening of the lid. The switch causes instantaneous de-energization of the motor and activation of an electrically controlled brake. Switches which have been used, of course, have their contacts enclosed in a housing to prevent the contacts and any electrically energized parts or insulating surfaces from being contaminated by electrically conductive detergent suds or spray or even by moisture which is prevalent in the high humidity ambient within the housing of a washing machine. A variety of switches have been designed with the intention of prohibiting entry into the switch housing of the conductive liquids which are present in the washing machine. Conventional switches typically have a movable plunger extending from the inside of the switch housing to the outside. The plunger is typically spring biased so it will cause the switch contacts in the housing to open when the force of the lid which holds the plunger depressed is removed. Switch actuators in the form of plungers and the like traditionally move linearly and act somewhat like a pump piston which results in aspirating humid air and liquid into the switch housing each time the plunger is depressed inwardly or is restored outwardly Problems of sealing the switch housing have been encountered in the design of lid operated switches. The switch housing cannot be made in one piece so a good seal is required between the parts of a two part housing. There are possible leakage paths along the electrical conductors which necessarily pass into the housing to connect with the contacts in the housing.

The new lid switch disclosed herein provides a solution to the foregoing problems. It is characterized as not being susceptible to damage by hot water, cold water, wetting agents, bleach, detergents and humid conditions found under the lid of a washing machine.

SUMMARY OF THE INVENTION

The new lid switch comprises a molded housing which is made in two parts that are sealed together after switch contacts, an actuator for the contacts and lead wires to the contacts are installed in one part of the housing. The switch is provided with an actuator lever which turns a shaft on which there is a cam that operates the switch contacts. The lid switch is mounted in a home automatic washing machine in a position where it will be in the path of movement of a portion of the washing machine lid so that when the lid is open the switch contacts will open and when the lid is closed, the switch contacts will close to permit the motor of the machine to run. Opening of the lid allows the lid switch to change state and bring about de-energization of the motor and activation of a brake in some machines so that the rotating basket in the machine will be safely stopped before the user can put his or her hands on the basket.

The new switch is characterized by operating reliably in the hostile environment under the lid of the washing machine as a result of it having the following features.

The two part housing is sealed using a photosensitive epoxy resin to provide both a perimeter seal around the interfacing edges of the housing parts and a potted type seal to the lead wires and a novel vent tube.

The changes in atmospheric pressure and temperature which would cause the switch to aspirate humid air from the environment are relieved by a vent tube which connects the interior of the switch housing to a less hostile region. The length, and particularly the volume of the tube, is such that expansion and contraction of the air within the switch respectively causes the air within the tube to flow away from the switch and to flow toward the switch, respectively, but not to reach the interior of the switch so the air within the switch does not change its quality.

The two halves or parts of the housing are formed such that one has a moat about its perimeter and the other has straight edges which register in the moat to provide a seal with the epoxy resin in the moat. The parts of the housing are provided with deflectable latches which hold the two parts of the housing together securely while the epoxy resin is curing.

The lid switch features a rotary shaft which is journaled in the housing and has an actuator lever extending radially therefrom so as to avoid the pumping action of prior art switches which was a significant source of contamination in such switches.

The housing parts are designed with labyrinth seals to prevent splashing liquids from entering the switch housing and there are self-draining vestibules or antechambers interposed between the main switch contact containing chamber of the housing so that any liquid which enters the exterior of the switch will drain out before it can enter the interior electric contact containing chambers. The concept of having vestibules in the switch housing where a movable switch contact operating member enters the housing, whether the member is a plunger or the shaft illustrated herein is important from the perspective of maintaining the contaminant free integrity of the contact chamber.

The switch actuator shaft has sharp edge drip seals so that any liquid moving along the shaft by capillary action will shed off into the vestibule without entering the main switch contact chamber.

The bearings for the switch actuator shaft are designed to control end play motion by providing thrust collars in the upper part of the housing and there is a slight offset of the walls which define the vestibules so that there is a gap between the collars and wall of the lower housing to prevent a capillary path between the collar bearing area and the bottom section of the vestibule.

The coil spring which returns the switch contact actuator lever to an unactuated position resulting from opening the lid is seized on the tapered end of an axially ribbed pin which is on a short lever arm extending from the actuator shaft to retain the spring and facilitate automated assembling and handling. Lead wires and internal electric terminal parts are designed so that the lead wires and terminals can be attached automatically to each other in conventional wire terminating equipment to improve the integrity of the new switch.

There are some subtle features in the lid switch such as rounded corners at places where partition walls and housing walls intersect and critically placed dots of sealant resin which interdict migration of liquid contaminants out of the vestibules and into the electric contact chamber of the switch housing.

How the foregoing objective and other objectives of the invention are achieved will appear in the ensuing description of an embodiment of the invention which will now be set forth in reference to the drawings.

DESCRIPTION OF A PREFERRED EMBODIMENT

Figure 1:
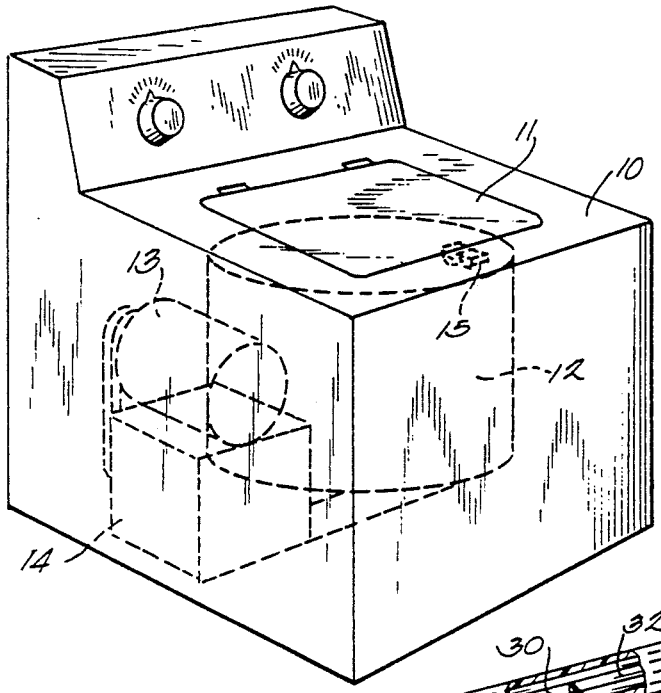
FIG. 1 is an isometric view of an automatic clothes washing machine in which the new lid switch is installed.

Attention is invited to FIG. 1 which illustrates an automatic clothes washing machine of the type widely used in homes. The body of the machine is usually porcelain enameled sheet metal which includes a top 10 and a hinged lid 11. The machine housing contains a stationary tub 12 in which there is a perforated rotary basket, not shown, which rotates about a vertical axis in the tub to effect centrifugal expulsion of water from clothes which reside in the basket. As is well known, an agitator, not shown, is disposed for oscillating about a vertical axis in the basket. An electric motor 13 is contained within the machine housing for driving the mechanism 14 for rotating the drum and driving the agitator by means of a belt. The new lid switch is depicted in FIG. 1 in dashed lines and is generally designated by the reference numeral 15. The lid switch is located in proximity with lid 11 which holds the lid switch in one state when the lid is down to a level coplanar with the top 10 of the machine housing and switches to another state when the lid is swung up to gain access to the contents of the basket in the tub 12.

Figure 2:
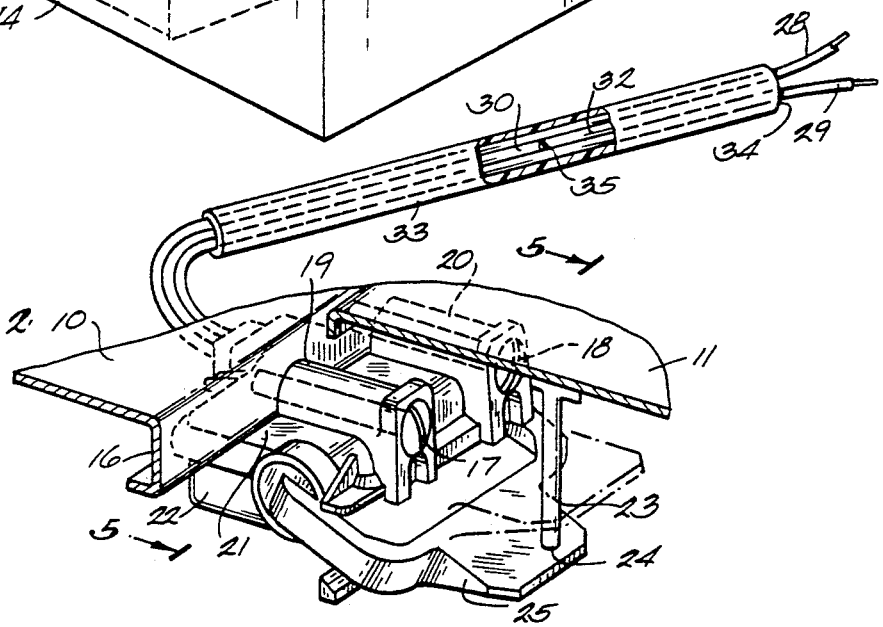
FIG. 2 shows more details of how the new lid switch is installed in an automatic clothes washing machine, the body of the machine and the lid, being shown fragmentarily.

The manner in which the lid switch is mounted can be more easily visualized in FIG. 2. Here it is possible to see that the top panel 10 of the washing machine has a vertically depending rim 16. Lid 11 is in closed condition, that is, it is coplanar with housing top 10. The lid switch housing is mounted to the rim 16 of top panel 10 by means of bolts 17 and 18 which pass through semicircular bosses 19 and 20 which are formed integrally with the top part 21 of the switch housing. The bottom part 22 of the housing is assumed to be sealed to the top part 21 at this time because the lid switch 15 is fully assembled and in operative condition. When the lid 11 is closed, the lid switch 15 is in a closed circuit state so the motor will be energized to rotate the basket.

In FIG. 2, a prong 23 is shown projecting downwardly from lid 11. The lower edge 24 of prong 23 is presently depressing the lid switch actuating lever 25 which is rotated clockwise, as viewed in FIG. 2, to its maximum permissible clockwise position where it comes up against a transversely extending stop member 26. When lid 11 is lifted open, actuator lever 25 is restored to a counterclockwise rotational limit which is established by the actuator lever butting against stop members such as the one marked 27 in FIG. 2.

Figure 3:
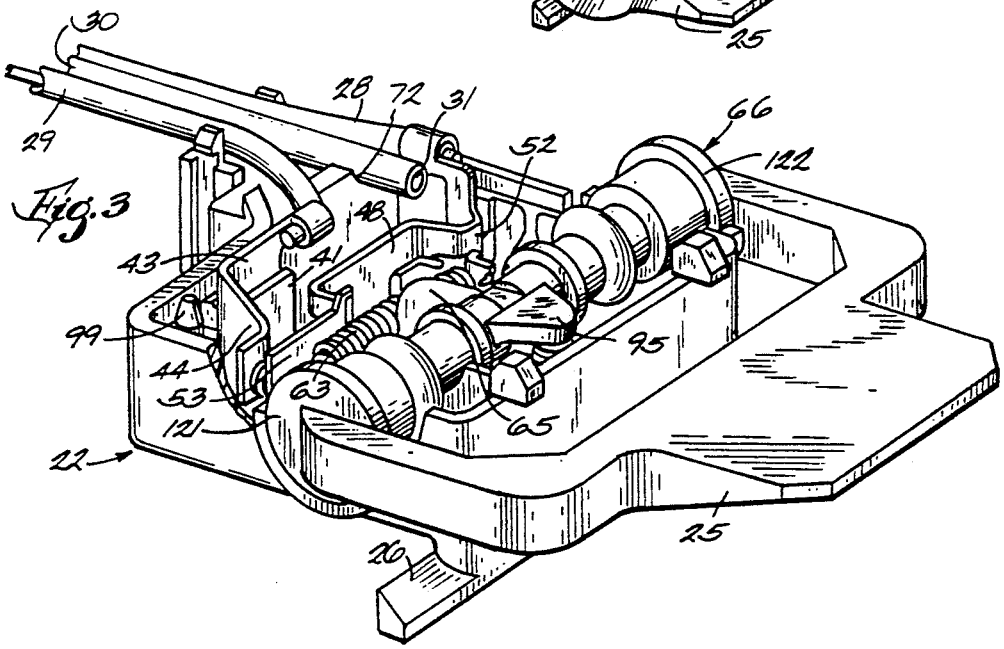
FIG. 3 is an isometric plan view of the lid switch showing the operating components assembled in one part of the two part housing and with the actuator lever depicted in an unactuated attitude.

Also in FIG. 2, two electric lead wires 28 and 29 are shown to be entering into the lid switch housing. The air expansion and contraction compensating tube 30 for the housing is also depicted in FIG. 2. One open end of tube 30 leads to the atmosphere and the other end is open to the interior or the lid switch housing as can be seen in FIG. 3. In an actual embodiment, the volume of air which can be contained in flexible tube 30 depends, of course, on the size of its bore and the length of the tube. The volume is at least as great as the volume of air which would be displaced from the lid switch housing when the volume of air in the housing is at its maximum temperature so that the expanded air from the housing would force some of the air out of the end of the vent tube 30 to the atmosphere but not all of the air out of the vent tube so that there would always be a core of air near the end of the tube for isolating the interior volume of the switch housing from the hostile atmosphere in the housing of the washing machine. When the minimum temperature of the air inside of the switch housing is reached due to the machine not being operated for a period of time so that the switch can come down to room temperature, the cooler air within the housing of the lid switch will have contracted only sufficiently to draw back in the air which it had displaced into the tube previously when it was hot so that no negative pressure relative to atmospheric pressure develops in the switch housing and no damp air will be drawn into the switch housing.

FIG. 2 illustrates how the outside open end 31 of vent tube 30 terminates inside of a tubular sleeve or shroud 33 which protects open end 31 against entry of liquid contaminants. The bore 32 extending from tube end 31 to the end of the shroud is long so the end shroud can be a great distance from where any contaminants might enter it.

Figure 4:
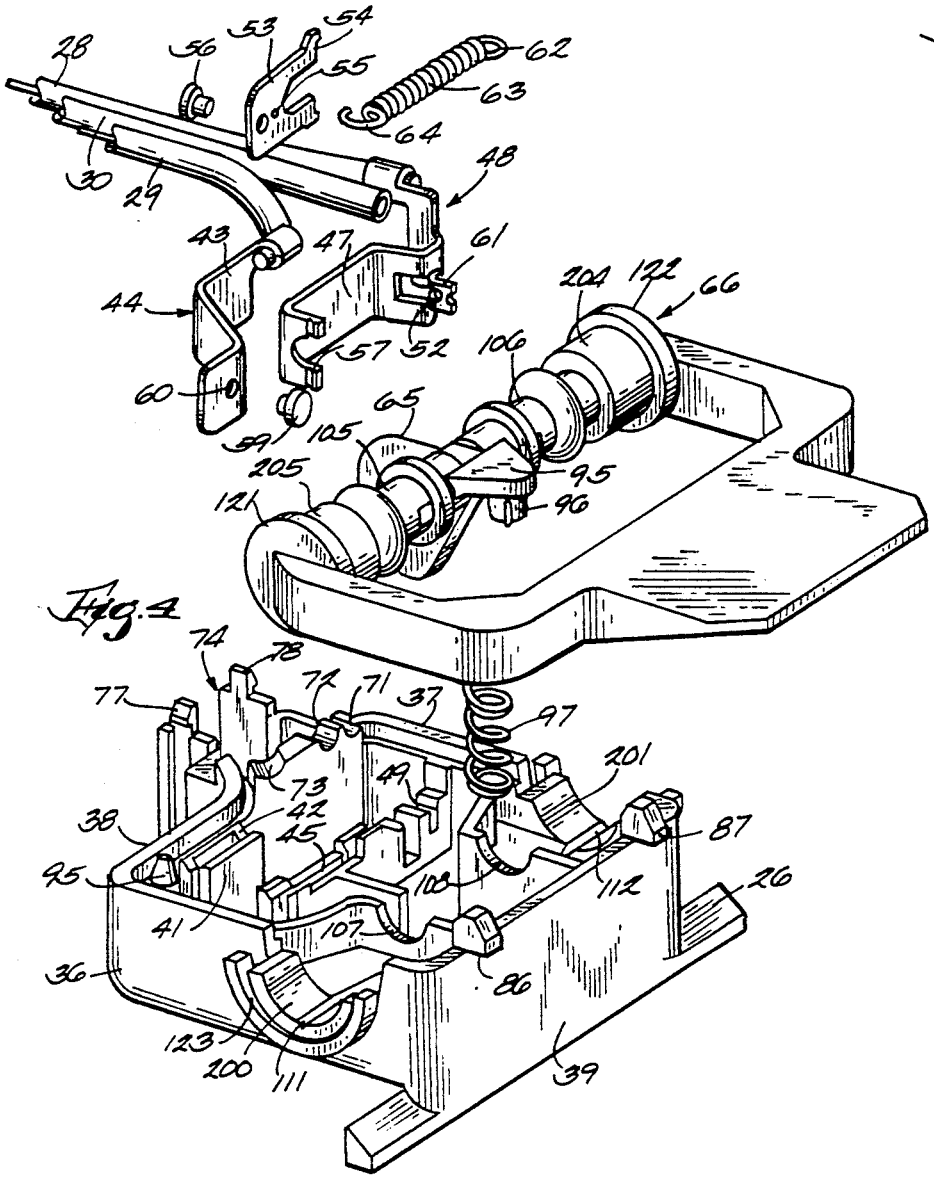
FIG. 4 is an exploded view of the components of the lid switch except that one part of the housing which would enclose the components is omitted.
Figure 6:
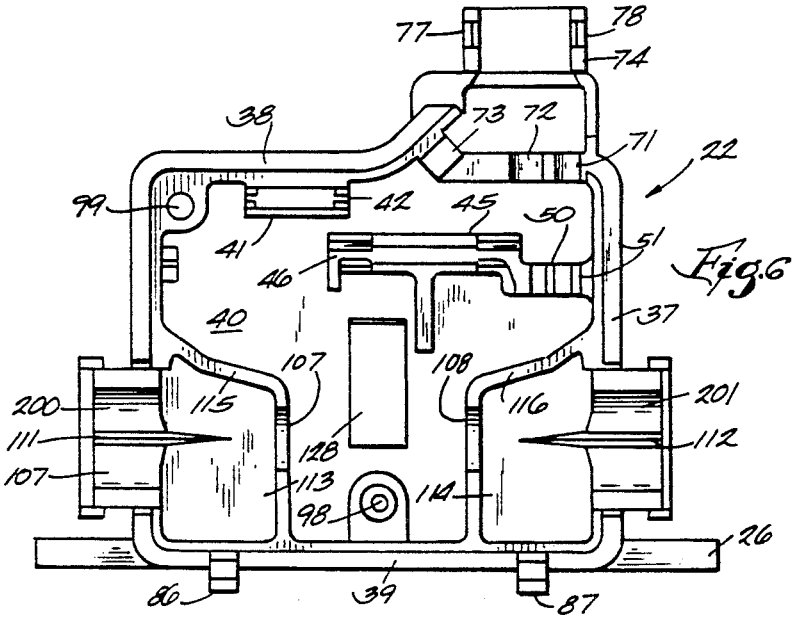
FIG. 6 is a plan view of one part of the lid switch housing which can be denominated the lower part for convenience.
Figure 7:
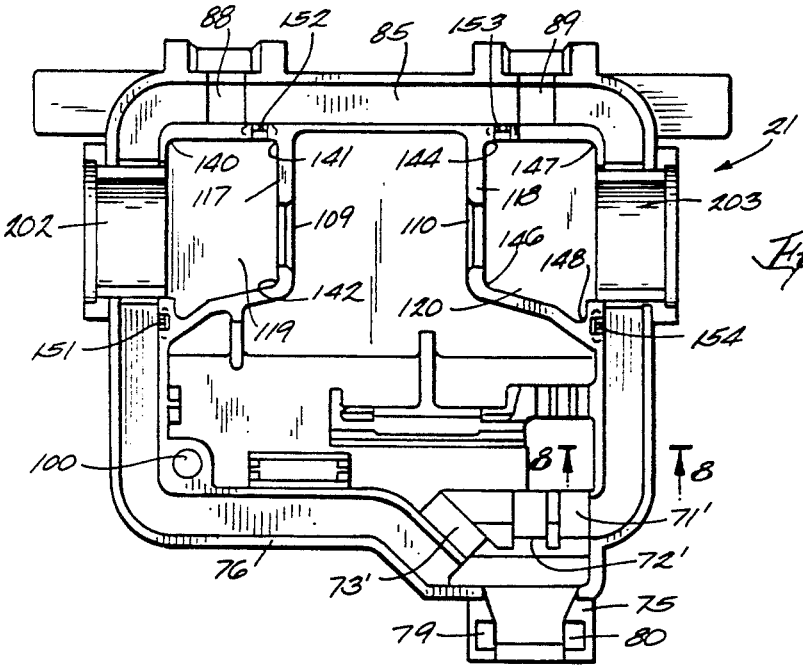
FIG. 7 is a plan view of the part of the lid switch housing which may be denominated the upper part for convenience.

Attention is now invited to the exploded view in FIG. 4 and to FIG. 6. These figures show what is arbitrarily and nominally called the bottom part 22 of the two part lid switch housing. In the preferred embodiment, what is arbitrarily called the bottom part 22 of the lid switch housing is molded as a single piece of a plastic material having electrical insulating properties. The part 21 which is arbitrarily called the top part 21 of the housing shown in FIG. 7 is similarly molded of plastic. The new lid switch can be mounted in various orientations. In FIG. 6 the interior of the nominally bottom part 22 of the housing can be visualized. In FIG. 7 the interior of the nominally top part 21 of the lid switch housing can be visualized. The open sides of the top housing part 21 and bottom housing part 22 are brought into interfacing relationship with each other to form the complete housing enclosure depicted in FIG. 2. Refer again to FIGS. 3, 4 and 6 for a discussion of the manner in which the interior of the nominally lower housing part 22 is configured. Housing 22 has four exterior walls, namely, side walls 36 and 37 and rear and front walls 38 and 39, respectively. The walls are formed integrally with the bottom panel of housing part 22 to define a chamber marked 40 in FIG. 6. As shown in FIGS. 4 and 6, bottom housing part 22 has some upstanding riser members such as the one marked 41. This member 41 has a vertical slot 42 for receiving the flat part 43 of an electric contact element 44 which is depicted in the FIG. 4 exploded view and is shown in its assembled position in FIG. 3. As shown in FIGS. 6 and 4, there is another riser 45 having a vertical slot 46 for receiving the flat part 47 of an electric terminal 48. Contiguous with riser 46 there is another riser 49 containing vertical slots 50 and 51 for accommodating a reentrant part 52 of electric terminal element 48 which is visible in exploded view in FIG. 4 and in assembled view in FIG. 3.

FIG. 4 shows a pivotable electric contact element 53 having knife edges such as the one marked 54 and a spring hook hole 55. Contact element 53 has a hole for accommodating the shank of a silver contact button 56. Knife edges 54 of contact element 53 nests in indentations 57 in contact element 48. When assembled, contact button 56 on element 53 is aligned with a corresponding contact button 59 whose shank is swaged in a hole 60 in contact element 43. Contact element 48 has a projection 61 to which the hook 62 at one end of a spring 63 can be engaged. The other hook 64 on spring 63 hooks into the hole 55 of contact element 53. When the contact elements 44 and 48 are in their assembled state as shown in FIG. 3, spring 63 is depressed centrally or transversely by a cam 65 formed on an actuator shaft which is generally designated by the numeral 66. The shaft will be described in detail later. The spring 63, with its central region so depressed transversely, causes the contact button 56 of contact element 53 to be swung into electric contact button 59 of contact element 43 to create a closed circuit condition so the washing machine tub can spin. The switch contacts are open when actuator lever 25 of the switch is not depressed as is the case in FIG. 3 which would correspond to the lid 11 of the washing machine being swung open. Under this condition motor 13 is open circuited and the basket cannot spin. The construction and function of the switch contacts and spring are basically similar to the snap acting switch described in the inventor hereof's U.S. Pat. No. 4,230,919 which is incorporated herein by reference.

One may visualize in FIG. 4 that the rear wall 38 of the lower part 22 of the lid switch housing has three semi-circular notches 71, 72 and 73 formed in it. FIG. 3 shows how the circular insulated wires 28 and 29 and the flexible plastic vent tube 30 nest in these notches so that one open end 35 of the vent tube is in communication with the main chamber of the lid switch housing. The top half of the housing 21 depicted in FIG. 7 has corresponding semi-circular notches 71', 72' and 73' for mating with the periphery of the wires and vent tube when the top part of the housing in FIG. 7 is mated with the bottom part in FIG. 6. There is a channel 74 formed integrally with the rear wall 38 of the bottom half 22 of the housing depicted in FIG. 6. There is a corresponding mating channel 75 formed on the rear wall 76 of the nominally bottom part 21 of the lid switch housing. As is evident in FIGS. 6, 4 and 3, there are upstanding and flexible latching fingers formed on the sides of channel 74 which terminate in beveled latching hooks 77 and 78. The channel portion 75 in FIG. 7 has openings 79 and 80 through which the hooked ends 77 and 78 of the flexible fingers project when the bottom part 21 of the housing is brought into congruency or mating relation with the bottom part 22 of the housing. This results in the hooked ends 77 and 78 latching onto the extension channel 75 to hold the top and bottom parts of the housing together after the electric terminals and operating mechanism is installed in the housing as will be discussed momentarily.

Figure 8:
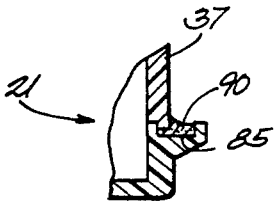
FIG. 8 is a vertical section taken on the line 8—8 in FIG. 7 for illustrating the configuration of the moat which is formed on the lower housing part and is filled with epoxy resin to effect an impervious seal with the illustrated fragment of the wall or edge of the upper part of the housing.

There is a channel, which can be called a moat 85 extending around the perimeter of the nominally top part 21 of the housing shown in FIG. 7. The bottom part has snap-in prongs 86 and 87 extending from its rear wall 39. As is evident in FIG. 4, these prongs 86 and 87 have the profile of hooks. Prongs 86 and 87 are beveled on one side to facilitate pressing them through holes 88 and 89, respectively, which pass through moat 85 in the bottom part 21 of the housing shown in FIG. 7. When the open sides of the top 21 and bottom 21 parts of the lid switch housing are brought into congruency, the prongs 86 and 87 are pushed through holes 88 and 89 so that, in conjunction, with the beveled end 77 and 78 of the latching fingers on the bottom part of the housing, the housing parts are what may be called tentatively mated to form a closed chamber interiorly of the housing. At this time, the four walls 36–39 of the bottom part 22 of the housing will register in the perimetral moat 85 of housing part 21. The switch assembly is then inverted so that the top opening of the moat is presented upwardly. As shown in FIG. 8, the moat 85 is then filled with liquid solidifyable resin 90 to thereby effect a secure seal between the walls, such as wall 37, of the bottom part of the housing 22 and the top part 21. In an actual embodiment, the sealant used is a photosensitive epoxy resin 90 which cures when it is exposed to ultraviolet light.

Figure 9:
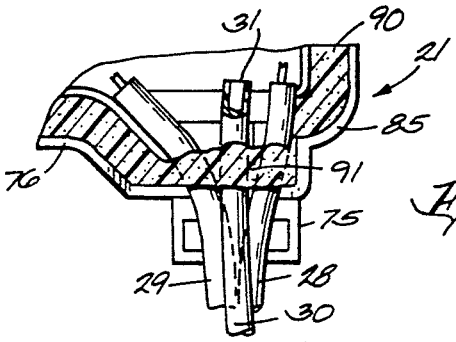
FIG. 9 shows a fragment of the lower part of the housing with its moat occupied by sealing resin shown in section and with the lead wires and vent tube entering and sealed into the housing.

FIG. 9 shows the moat containing epoxy resin 90 which results in sealing the electrical conductors 28 and 29 and the vent tube 30 into the lid switch housing. The channel 74 on the bottom part 22 of the housing in FIG. 6 and the channel 75 on the top part 21 in FIG. 7 interface to form a duct through which the lead wires 28, 29 and vent tube 30 pass. As shown in FIG. 9, the layer of epoxy resin 91 is applied where the wires 28 and 29 and vent tube 30 pass through the rear wall 76 of the lower part 21 of the housing. The wires and tube are sealed in resin.

Referring to the FIG. 4 exploded view, actuator shaft 66 has a short lever 95, fastened integrally to it. There is a pin having an axially ribbed conical end 96 projecting downwardly and integrally from short lever 95. A coil spring 97 has its upper open end pushed onto cone 96 and the radially outward spring action resulting from the ribs on the cone causes the spring to seize the cone so there is no chance for the spring to drop away during assembly of the switch or at any other time. As shown in FIG. 6, there is an upstanding pin 98 on which the lower end of spring 97 fits so the spring cannot slip sideways. This spring restores the actuating lever 25 from its angulated position in FIG. 2 which results from it being depressed by prong 23 on the lid to its horizontal or unactuated position depicted in phantom lines in FIG. 2. When the actuating lever is horizontal as it is in FIG. 3 and as it is depicted in phantom lines in FIG. 2, it means that the lid is opened and the switch contact buttons 56 and 59 in the housing are separated in which case the motor 13 is open circuited and braked so that it is safe to access the stopped rotatable basket which is reposed in tub 12 of the automatic clothes washing machine depicted in FIG. 1.

Referring to FIG. 4, a tapered dowel pin 99 extending from the bottom of bottom housing part 22 shown in FIGS. 3 and 6 enters a corresponding hole 100 which assures that the upper and lower parts 21 and 22 of the housing are properly aligned with each other when the two housing parts are mated.

Actuator shaft 66 is designed to inhibit leakage which could result from capillary action or possibly regular conduction of liquid from the outside to the inside of the switch housing. The construction of the shaft can be visualized most easily in FIGS. 4 and 5. Here one may see that the shaft has cylindrical journals 105 and 106 inwardly from its ends. These journals reside in bearings which are composed of semi-cylindrical recesses constituting bearing parts 107 and 108 in the bottom part 22 of the housing and mating semi-cylindrical recesses constituting bearing parts 109 and 110 in bottom housing part 21 shown in FIG. 7. Bearing recesses 105–108 are formed in partition walls 115–118 which define vestibules 113, 114, 119 and 120 which will be elucidated later.

The shaft has cylinders 204 and 205 formed on it. The laterally spaced apart walls of the lower housing part 22 have semi-cylindrical bushings 200 and 201 formed in them and there are mating counterpart bushings 202 and 203 in the top housing part. Shaft cylinders 204 and 205 reside in these bushings but they do not act as bearings. There are clearances 101 and 102 around cylinders 204 and 205 great enough to inhibit capillary action.

Figure 5:
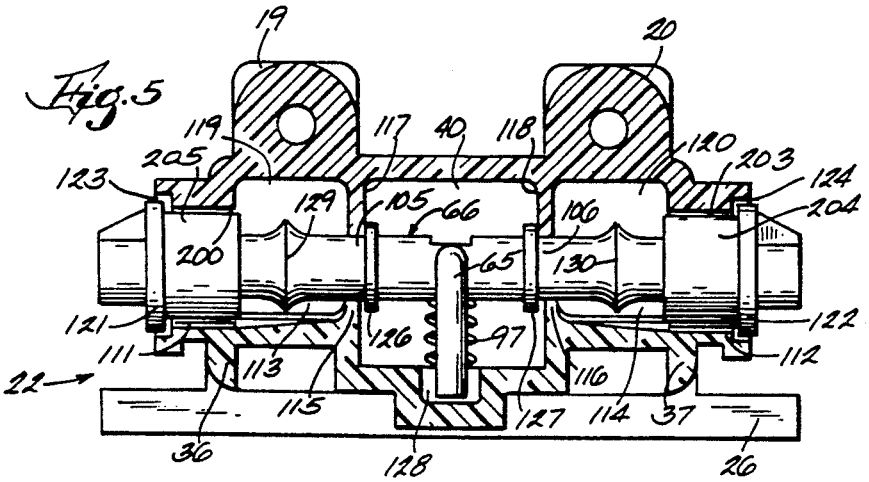
FIG. 5 is a vertical sectional view taken on a plane corresponding to 5—5 in FIG. 2.

As shown in FIGS. 5 and 6, the bottom halves of clearance bushings 200 and 201 have small drain troughs 111 and 112 which extend into the base part of the bottom part 22 of the housing. The areas 113 and 114 are characterized as vestibules because they are isolated from the main chamber 40 of the housing parts. The vestibules 113 and 114 are defined by partition walls 115 and 116 in the bottom part 22 of the housing and by corresponding mating partition walls 117 and 118 in the top part 21 of the housing. The drain troughs 111 and 112 extend into the vestibules. When the housing parts 21 and 22 are mated, the edges of wall 115 in nominally bottom housing part 22 interface in sealing relationship with the edges 117 in housing part 21. Similarly, the edges of walls 116 in housing part 22 of FIG. 6 interface in sealing relationship with the edges of walls 118 in FIG. 7. The walls 117 and 118 in FIG. 7 define the top parts 119 and 120 of the vestibules whose bottom parts 113 and 114 are defined or bounded by the walls 115 and 116. The vestibule walls are upstanding from the bottom and top surfaces of the respective top and bottom parts 21 and 22 of the housing so that they isolate the vestibules from the main chamber 40 which contains the electrical parts in the housing. The cylindrical parts 204 and 205 of shaft 66 are enclosed within the mated semi-cylindrical bushings 200, 202 and 201, 203 and the journals 105 and 106 of the shaft are enclosed within semi-circular bearing parts 131 and 132 when they are mated by mating of the housing top and bottom parts 21 and 22, respectively. Note that the shaft journals 105 and 106 are contiguous with the vestibules.

Formed immediately adjacent cylindrical sections 204 and 205 of shaft 66 are annular collars 121 and 122 which constitute splash shields. There are annular pockets 123 and 124 formed in the housing in which the splash shields 121 and 122, respectively, reside. The small clearance between the annular splash shields 121 and 122 and the respective pockets 123 and 124 inhibits entry of liquid into the switch housing. The close clearance interface of the cylindrical shaft section 204 with mating semi-cylindrical surfaces 201 and 203 on one side of the housing parts and the interface of cylindrical shaft section 205 of the shaft with semi-cylindrical surfaces 200 and 202 on the laterally opposite side of the housing parts further inhibits flow of any liquid into the vestibules 119 and 120, respectively. As is most evident in FIG. 5, radially extending collars 126 and 127 which are molded integrally with the shaft keep shaft 66 centered within the switch housing. Note how the switch contact operating cam 65 extends into a depression 128 in the bottom housing part 22 to avoid interference when the cam swings with the shaft. Also note in FIG. 5 that the shaft is provided with pointed drip rings 129 and 130 for causing any moisture entering along the shaft journals 105 and 106 to drip off into the self-draining vestibules one of which is composed of vestibule halves 113 and 119 and the other of which is composed of vestibule halves 114 and 120.

The partition walls 113 and 116 which define the vestibules in the bottom portion of FIG. 6 and have bearing journals 107 and 108 in them to support the shaft 66 and for the shaft to cross over the mated partition walls 115 and 117 and the mated partition walls 116 and 118 in the top part 21 of the housing in FIG. 7 have the semi-circular bearing journals 109 and 110 in them for the same purpose.

Note in FIG. 5 that the partition walls 117 defining the vestibule in the upper part of the housing are slightly overlapping but offset by a small amount from the wall 115 forming the half of the same vestibule in the lower part of the housing. Similarly, wall 118 in the upper part of the housing is slightly overlapping but offset from the wall 116 in the lower part 22 of the housing so that there is a small semi-circular gap or step back between the collars 126 and 127 from the lower walls 115 and 116 to prevent any liquid on the shaft in vestibule 113, 17 and 114, 120 from migrating by capillary action into the internal switch chamber 40.

The propensity for liquids to migrate across barriers in devices such as the lid switch described herein is tested by designers by applying a commercially available extremely low surface tension liquid to one side of a barrier to see if the liquid will migrate across or through a joint. It was discovered that the test liquid migrated profusely where the partition walls 115–118 come together or interface in a prototype. Surprisingly, the applicants discovered that this migration could be stopped by rounding the corners where there are intersections of barriers. Hence, according to the invention, the sharp corners were abandoned and, as demonstrated in FIG. 7, the corners 140–148 were rounded. When this was done, even leakage of the test liquid which represents its worst case was stopped. The corresponding corners of the vestibule partitions in FIG. 6 are also rounded but are not numbered. Another surprisingly effective inhibitor of liquid migration resides in applicants discovery that strategically located dots of sealant such as epoxy resin could accomplish this result.

Referring to FIG. 7, several dots of a settable sealant, such as epoxy resin dots 151–154 are deposited on the wall edges before the two housing parts 21 and 22 are joined to form a unitary housing These dots are placed on the wall edges where partition walls which define the vestibules intersect to form corners which have a propensity for inducing liquid migration. The sealant dots harden and contribute to inhibiting liquid migration.

In summary, a new lid switch has been described which is characterized by having the switch contact operating shaft journaled in the housing for rotation to prevent the pumping action which occurred in prior art switches that resulted in inducing liquid into the switch contact containing chamber of the housing. The lid switch is further characterized by having means in the housing which define vestibules in which opposite end portions of the shaft are disposed with draining means in the vestibules for preventing liquid from entering the internal chamber of the switch housing which contains the electrical parts. Changes of pressure in the switch induced by temperature changes are compensated by using a vent tube which retains a column of air that blocks entry to the contact containing chamber of the switch. The perimeter of the one housing part of the two parts which comprise the housing of the switch is provided with a moat into which the other part registers and provides for flowing a liquid and hardenable sealing material into the moat for making the joint between the two parts of the housing liquid proof. The switch actuator shaft has pointed or shaft annular rings which cause any liquid flowing along the shaft to drop into the vestibules and drain out of the housing through small troughs formed in the bottom of the vestibules. The switch is further characterized by interfacing components of the housing and collars, bearing surfaces of the switch actuating shaft coacting in a manner that inhibits creeping of liquid into the switch by capillary action and which interrupts such leakage and accommodates it by intercepting it in vestibules and draining it out through troughs. The shaft is further characterized by having at its opposite ends splash seals which reside in annular pockets to inhibit flow of liquid from splashes into the vestibules.

Although a preferred embodiment of the new lid switch has been described in substantial detail, such description is intended to be illustrative rather than limiting, for the features of the switch may be variously embodied and are to be limited only by interpretation of the claims which follow.

We claim:

1. A lid switch for being mounted to a clothes washing machine for operating in response to opening and closing the lid, including:

a first insulating housing part comprised of a nominally bottom wall having side wall means projecting therefrom to define an open cavity, a second insulating housing part comprised of a nominally top wall having side wall means projecting therefrom to define an open cavity, the side wall means of each of said housing parts being generally similarly configured for being superposed and combined to define a chamber within a unitary housing, electrical switch contacts and means in said chamber for supporting said contacts, at least one of said contacts being operable into and out of closed and open circuit condition, respectively, relative to the other, each housing part having in its cavity corresponding laterally spaced apart partition walls projecting from said top and bottom walls, respectively, which when said housing parts are superposed and combined define a laterally spaced apart vestibule which is separated from said chamber, said vestibules having means for draining liquid out, and a switch contact operating member movably mounted in said housing and extending into said vestibule and including means for operating said contacts.

2. The lid switch according to claim 1 wherein said means for draining said vestibule comprises a drain trough in the bottom of each vestibule, said trough respectively directed outwardly of the vestibule for draining away any liquid which might migrate into said vestibule along said switch operating member.

3. The lid switch according to claim 1 including:

a tube having a predetermined length and opening size extending sealingly into said housing, one open end of the tube being inside of said housing and the other open end being outside of said housing for prohibiting development of negative air pressure in said housing and for accommodating expansion of air in said housing.

4. The lid switch according to claim 3 wherein said lid has a length and inside size at least sufficiently larger, respectively, to define a volume sufficiently large to accommodate the quantity of air forced into said tube due to expansion of air from said housing when said housing is at its maximum expected temperature without displacing all of the air from the tube.

5. The lid switch according to any one of claims 3 or 4 including a shroud having an opening at a substantial distance from the environment proximate to said switch housing, said open end of said tube outside of said housing being disposed in said shroud for being protected against entry of contaminants into said tube.

6. A lid switch for being mounted to a clothes washing machine for operating in response to opening and closing the lid, including:

a first insulating housing part comprised of a nominally bottom wall having side wall means projecting therefrom to define an open cavity, a second insulating housing part comprised of a nominally top wall having side wall means projecting therefrom to define an open cavity, the side wall means of each of said housing parts being generally similarly configured for being superposed and combined with the cavities interfacing to define a chamber within a unitary housing, electrical switch contacts and means in said chamber for supporting said contacts, at least one of said contacts being operable into and out of closed and open circuit condition, respectively, relative to the other, each housing part having in its cavity a pair of corresponding laterally spaced apart partition walls projecting from said top and bottom walls, respectively, which when said housing parts are superposed and combined define laterally spaced apart vestibules which are separated from said chamber, said vestibules having means for draining liquid out, coaxial semi-cylindrical surfaces formed in opposite laterally spaced apart side walls of each housing part contiguous with each vestibule for forming cylindrical surfaces when said housing parts are superposed and combined, said partition walls of said vestibules having bearings for a shaft aligned with the axis of said cylindrical surfaces, a switch contact operating shaft having cylindrical surfaces adjacent opposite laterally spaced apart ends disposed with close clearance in said cylindrical surfaces, respectively, said shaft being adapted for operating said switch contacts when said shaft is rotated, said shaft having journal portions extending through said vestibules and registering in said bearings in said partition walls to further close off said vestibules from said chamber.

7. The lid switch according to claim 6 wherein said means for draining said vestibules comprises a drain trough in the bottom of each vestibule, said troughs respectively directed outwardly of the vestibules for draining away any liquid which might migrate into said vestibules along the journals of the shaft.

8. The lid switch according to claim 6 including annular splash shields formed integrally with said cylindrical shaft surfaces on said shaft axially outwardly of said vestibules, respectively, said housing having circular pockets formed in it into which said annular splash shields are fitted closely for effecting a sealing relation that inhibits splashed liquid from entering said vestibules.

9. The lid switch according to claim 6 wherein the parts of said shaft which pass through said vestibules have radially extending drip rings formed on them for lengthening the path for liquid to flow toward said chamber and for inducing dripping of any liquid from the shaft into said vestibule for being drained therefrom.

10. The lid switch according to claim 6 including sealing collars formed on said shaft immediately adjacent said bearings in said partition walls which define said vestibules, said shaft being in direct sliding contact with the partition wall of the vestibules in one of said parts of said housing and the corresponding superposed partition walls of the vestibules in the other part of said housing contacting but being slightly offset from said partition walls in said one part so there is a small gap between said collars and the partition walls of said vestibules in said other part of said housing for inhibiting migration of liquid due to capillary action from said vestibules to said chamber.

11. The lid switch according to any one of claims 6, 7, 8, 9 or 10 wherein a moat is formed on said walls of one of said housing parts and the walls of the other of said housing parts register in said moat when said housing parts are superposed, and a settable liquid sealing material deposited in and about the joint formed between said moat and said walls of said other housing part.

12. The lid switch according to claim 6 including:

a tube having predetermined length and opening size extending sealingly into said housing, one open end of said tube being inside of said housing and the other open end being outside of said housing for prohibiting development of negative air pressure in said housing relative to atmospheric pressure and for accommodating expansion of air in said housing.

13. The lid switch according to claim 6 wherein there is a radially extending switch contact actuating lever fastened to said shaft on a part of said shaft extending from said housing, a cam on said shaft for actuating a switch contact in response to the opened or closed position of the lid, a shaft lever arm extending radially from said shaft inside of said housing and an axially ribbed pin formed on said short lever arm, a coil spring means having one end opening fitted on said split pin, said spring means being interposed between said short lever arm and said housing, depression of said switch contact actuating lever by said lid when said lid is closed causing said actuating lever to be rotated from an initial position through a limited angle to cause closure of said contacts and compressive loading of said spring means, and opening of said lid allowing said spring to restore said lever to said initial position for causing said switch contacts to open.

14. The lid switch according to claim 13 wherein said tube has a length and an inside size at least sufficiently long and large, respectively, to define a volume sufficiently large to accommodate the quantity of air forced into said tube due to expansion of air from said housing when said housing is at its maximum expected temperature without displacing all of the air from the tube.

15. The lid switch according to any one of claims 13 or 14 including a shroud which has an opening at a substantial distance from the environment proximate to said switch housing, said open end of said tube outside of said housing being disposed in said shroud for being protected against entry of contaminants into the tube.

16. The lid switch according to claim 6 wherein said partition walls that define said vestibules have opposite ends which join integrally with other walls in each housing part such as to create corners which are coextensive with the height of the walls, said corners being rounded to inhibit migration of liquid along said corners.

17. The lid switch according to claim 6 including dots of a settable sealant applied to at least one of said two housing parts before said parts are superposed to form a unitary housing, said dots being applied on the surfaces of the walls of the housing next to said partition walls contiguous with said vestibules for inhibiting migration of liquid from said vestibules.

18. The lid switch according to claim 1 wherein said partition walls defining said vestibules intersect with said side wall means to form corners, said corners having a radius of curvature for inhibiting the flow of liquid along the corners by capillary action.

* * * * *